United States Patent [19]

Racca et al.

[11] Patent Number: 4,577,783

[45] Date of Patent: Mar. 25, 1986

[54] DISPENSER

[75] Inventors: Richard F. Racca, Melrose; Willem Swier; Anthony E. Di Maio, both of Georgetown, all of Mass.

[73] Assignee: Marson Corporation, Chelsea, Mass.

[21] Appl. No.: 103,526

[22] Filed: Dec. 13, 1979

Related U.S. Application Data

[63] Continuation of Ser. No. 624,642, Oct. 22, 1975, abandoned, which is a continuation of Ser. No. 341,759, Mar. 15, 1973, abandoned, which is a continuation-in-part of Ser. No. 292,722, Sep. 27, 1972, abandoned, which is a continuation of Ser. No. 833,259, Jun. 16, 1969, abandoned.

[51] Int. Cl.[4] ..... B67D 5/54

[52] U.S. Cl. ..... 222/386.5; 222/389

[58] Field of Search ..... 222/386, 386.5, 387, 222/389, 326, 327

[56] References Cited

U.S. PATENT DOCUMENTS

| | | | |
|---|---|---|---|
| 964,866 | 7/1910 | Watson | 222/389 |
| 1,207,752 | 12/1916 | Harrison | 222/389 |
| 1,761,875 | 6/1930 | Cordell et al. | 222/389 |
| 2,593,362 | 4/1952 | Taylor | 222/389 X |
| 3,022,923 | 2/1962 | Hoffman | 222/389 X |
| 3,245,591 | 4/1966 | Kneusel et al. | 222/389 |
| 3,275,200 | 9/1966 | Livingstone | 222/389 |
| 3,315,847 | 4/1967 | Trumbull | 222/389 |
| 3,367,545 | 2/1968 | Cook | 222/327 X |
| 3,603,487 | 9/1971 | Cook | 222/389 |

*Primary Examiner*—Joseph J. Rolla
*Assistant Examiner*—Frederick R. Handren
*Attorney, Agent, or Firm*—Pennie & Edmonds

[57] ABSTRACT

A dispenser for high viscosity fluid materials is disclosed which includes a container of predetermined inside diameter, a selectively operable valve means providing, in open condition, an outlet flow passage for a fluid material and propelling means for forcing the fluid material through the flow passage and out of the container. The propelling means comprises a follower plate disposed in contact with the fluid material and mounted for movement toward the valve means to force the fluid material out of the container. The configuration, the structure and dimensional relationships between various portions of the follower plate are carefully controlled to provide a unique, dependable and effective fluid material discharge from the container as the follower plate is moved toward the open valve means.

1 Claim, 12 Drawing Figures

DISPENSER

CROSS REFERENCE TO RELATED APPLICATIONS

This application is a continuation of application Ser. No. 624,642, filed Oct. 22, 1975, which, in turn, was a continuation of application Ser. No. 341,759, filed Mar. 15, 1973, which in turn, was a continuation in part of application Ser. No. 292,722, filed Sept. 27, 1972, which, in turn, was a continuation of application Ser. No. 833,259, filed June 16, 1969. Application Ser. No. 624,642 and each application in the chain of applications from application Ser. No. 833,259 have become abandoned.

BACKGROUND OF THE INVENTION

This invention relates to a dispenser which is preferably utilized to dispense high viscosity fluid materials such as, for example, automobile body solder, automobile body filler, other filler compositions of various types, putty, and materials of similar type.

Conventionally, materials of this class are relatively difficult to handle. These materials are normally supplied in various types of containers and, in use, are scooped out of the container with a spatula or similar device.

This method of removing the material from the container is difficult. In the first place, the material will, of course, get on the hand of the user and sometimes it is difficult to remove the material from the container. If the material is somewhat corrosive, various types of dermatitis will be encountered. In addition, even aside from this, the use of a spatula or similar device to remove material from the container means that approximately five to ten percent of the material is not so removed because it cannot be conveniently handled.

The dispenser of this invention avoids the disadvantages of the prior devices and produces a method of utilizing all of such material, permits the material to be conveniently removed from the container, and avoids the other disadvantages of the prior devices.

SUMMARY OF THE INVENTION

The dispenser of this invention comprises, in brief, outlet valve means and fluid pressure means which are in operative relationship with the material to be dispensed.

In the preferred modification of this invention, the material to be dispensed is disposed within a container which includes a closed bottom and an open top. The closed bottom has valve means therewithin for selectively producing an outlet opening. The bottom of the container is disposed upon a base plate which has an outlet valve member therewithin, which outlet valve member is controlled by means of an operating handle. Above the container is disposed a top member which contains pressure-producing drive means therewithin. This pressure-producing means may optionally consist of a conduit which is connected to an external pressure source such as an air compressor may include a pressure pump member which will produce the necessary gas pressure. Where the pressure pump member is utilized, it is preferably electrically driven. Optionally, also, a relief or "safety" valve may also be employed.

Situated within the container in contacting relationship to the fluid material is a specially constructed follower plate. The follower plate is moveable within the container toward the valve means. The follower plate is moved forcefully toward the valve means to discharge fluid material by a drive means which may consist of the source of compressed air mentioned above. In construction, the follower plate has a bottom wall contacting the fluid material and an upstanding side wall extending about the periphery of the bottom wall.

The follower plate has an outside diameter equal to a dimension ranging between about 0.015 inch greater than the inside diameter of the container and 0.018 inch less than said inside diameter. The effective side wall height of the follower plate is equal to at least ten percent of its outside diameter; and the follower plate is made of a material sufficiently flexible and resilient to be flexed without permanent deformation into a configuration such that its outside diameter is reduced by an amount approximately equal to any negative clearance existing between the follower plate and the inner surface of the container. With this arrangement, the dispenser can be operated with less pressure inasmuch as relatively little friction exists between the follower plate and the container. This in turn, provides a safer operation with no danger of creating a high pressure condition within the container which may result in an explosion.

DETAILED DESCRIPTION OF THE INVENTION

Figure 1:
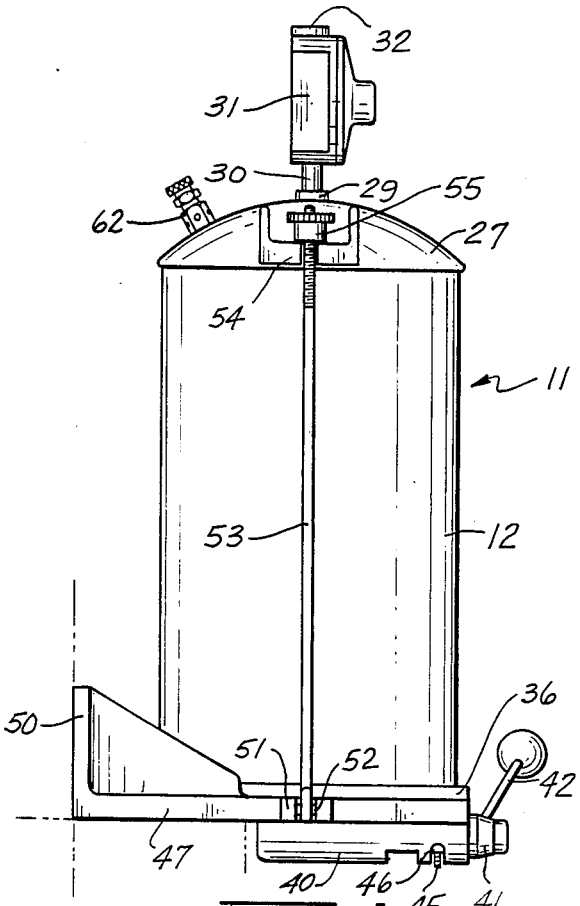
FIG. 1 is a side view of one form of dispenser made in accordance with this invention.
Figure 5:
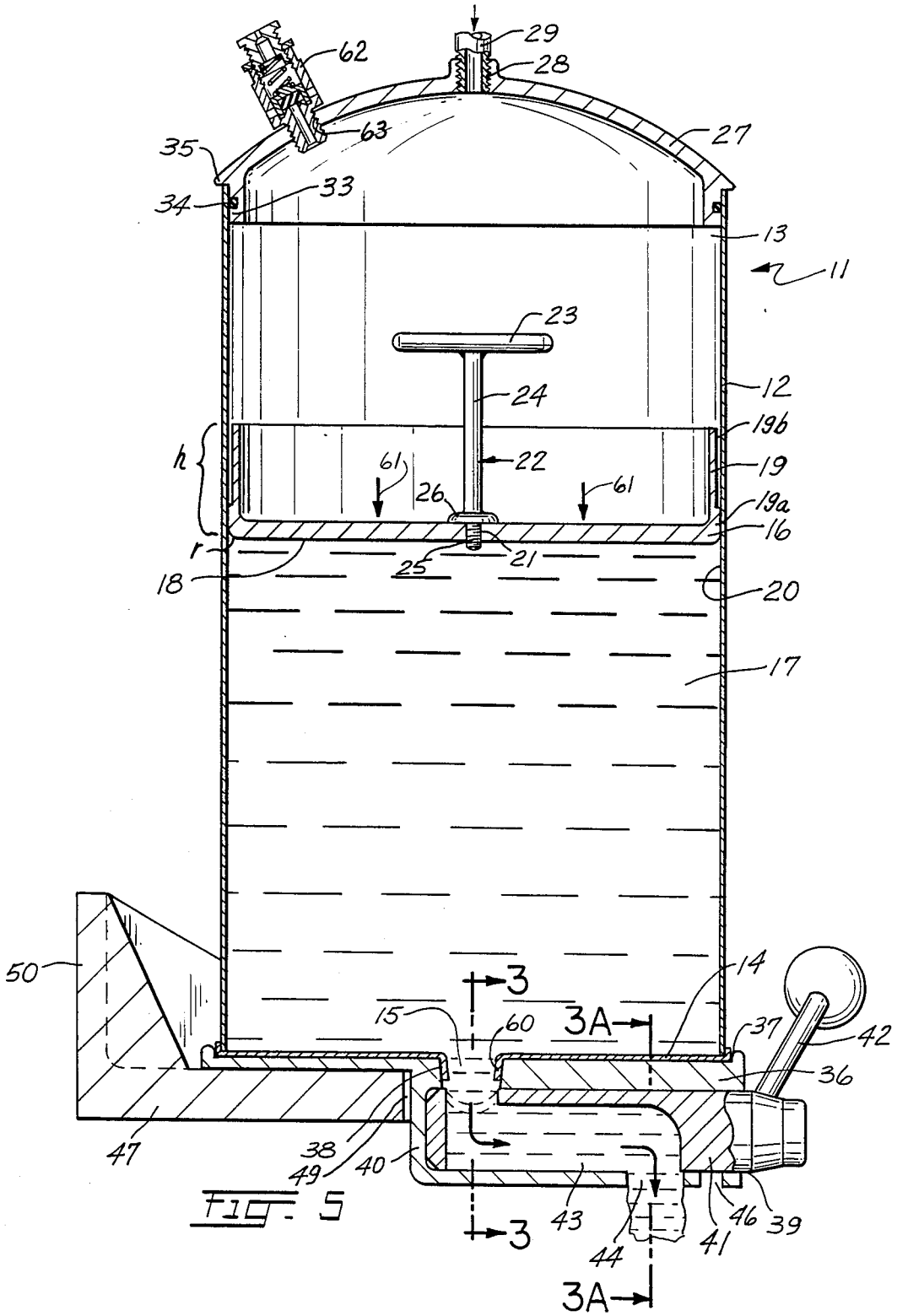
FIG. 5 is a longitudinal cross-sectional view, on an enlarged scale, showing the internal construction of parts and the direction of flow of material to be dispensed.

With reference to FIG. 1, the dispensing device 11 of this invention is utilized in connection with a container 12 and preferably container 12 is formed with an open top 13 and a closed bottom 14 (see FIG. 5). With continued reference to FIG. 5 it will be noted that an opening 15 is located within bottom 14 of a container 12, and a downwardly depending flange 60 surrounds opening 15. A removable plug (not shown) is disposed within the opening. Within container 12 is a plate member 16 which operates as a propelling member for material 17 within the container as will be subsequently explained.

Plate member 16 is formed with a bottom portion 18 and upstanding side portion 19. Side portion 19 abuts the side wall 20 of the container 12.

Within plate 16 is a threaded opening 21. Selectively disposable within threaded opening 21 is a holding member 22 which is also formed with a handle portion 23, a shaft portion 24, a threaded base portion 25 and a cap portion 26.

Figure 2:
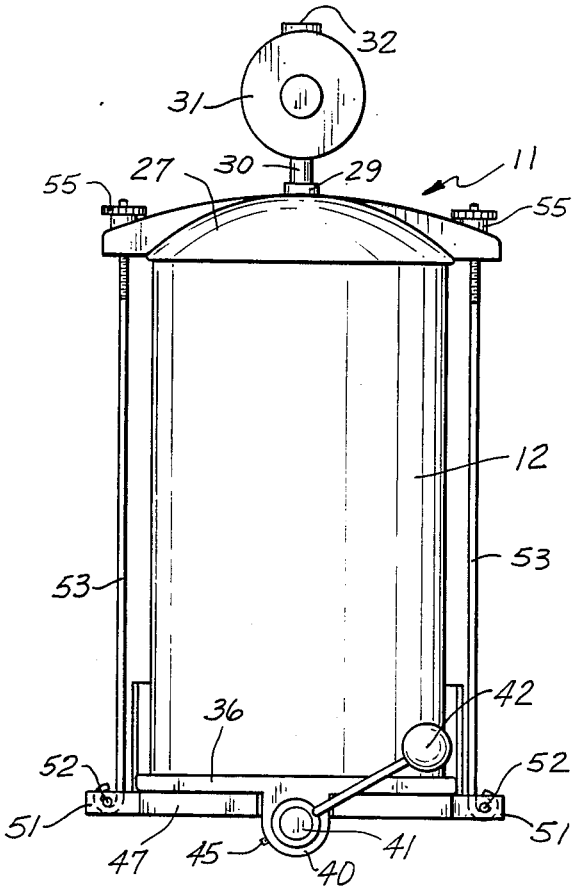
FIG. 2 is a front elevational view of the form of invention shown in FIG. 1.
Figure 3:
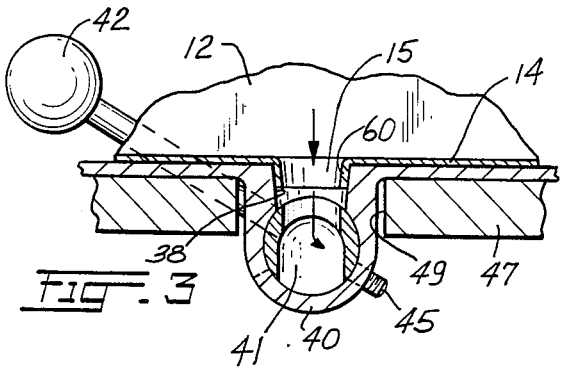
FIG. 3 is a fragmentary cross-sectional view of a portion of the outlet valve of this invention taken along lines 3—3 of FIG. 5. In this view the outlet valve is in open position.
Figure 4:
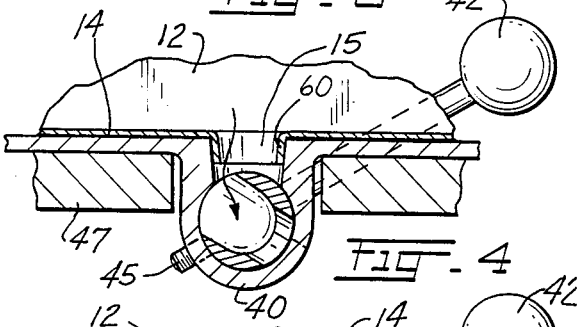
FIG. 4 is a fragmentary cross-sectional view similar to that of FIG. 3 but with the outlet valve in closed position.
Figure 3A:
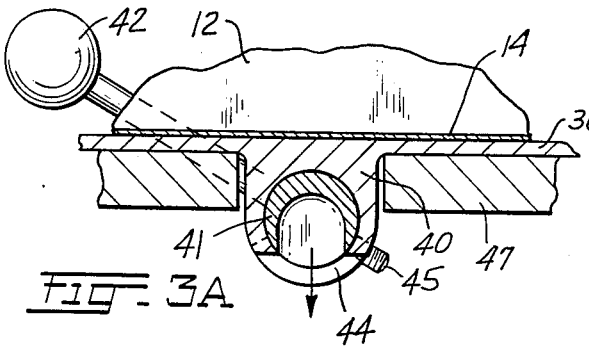
FIG. 3A is a fragmentary cross-sectional view of another portion of the outlet valve means of this invention taken along lines 3A—3A of FIG. 5. In this figure, the outlet valve is also in open position.
Figure 4A:
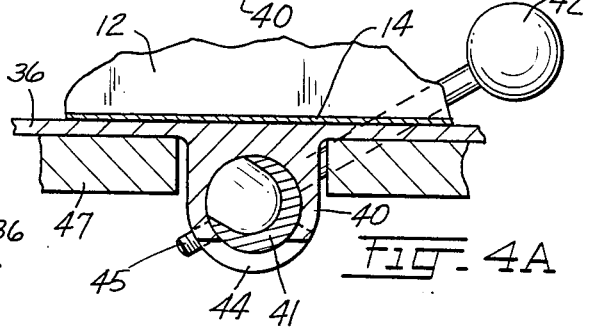
FIG. 4A is a fragmentary cross-sectional view similar to that of FIG. 3A but with the outlet valve in closed position.

Above container 12 is a top member 27 preferably in the form of a dome and containing an opening 28 therewithin. Opening 28 bears a threaded fitting 29 to which is attached a fitting 30 which in turn is connected to a reducing valve 31 (See FIGS. 1 and 2). Reducing valve 31 is in turn connected to a source of compressed air through opening 32 which is in turn connected to a conduit (not shown) which in turn is connected to a source of compressed gas such as an air compressor, tank, or the like. A relief valve 62 is also provided and is connected to opening 63 (see FIG. 5) to relieve excess pressure.

Top member 27 also bears a downwardly depending side 33 which also abuts side wall 20 of container 12. Within side 33 an O-ring 34 for sealing purposes may be provided. A lip 35 is also provided overlying side wall 20.

A base 36 is provided which bears a recess 37 which is adapted to support the bottom 14 of container 12. Base 36 bears an opening 38 which is adapted to be placed in registration with opening 15. Opening 38 communicates with barrel-shaped opening 39 located within downwardly projecting portion 40 of base 36. Within barrel-shaped opening 39 is outlet valve cylinder 41 which is rotatably movable within barrel-shaped opening 39 by means of handle 42 connected thereto. Valve cylinder 41 also has an opening 43 therewithin which is selectably registerable with outlet opening 44 located within lower base extension 40. A pin 45 (see FIG. 1) is also connected to outlet valve cylinder 41 and is disposed within limit recess 46 disposed within lower base extension 40.

A bottom support plate 47 bears a recess 49 which accommodates lower base extension 40. An upwardly extending rear portion 50 is also provided. A pair of outwardly extending ear portions 51 are provided within bottom support plate 47 and a pair of pins 52 are disposed with these recesses. A pair of supports 53 are pivotally connected to pins 52 and in turn are disposed within slots 54 which are located on opposite sides of top member 27. Supports 53 are selectively retained within recesses 54 by means of knobs 55 which are threadably connected to supports 53.

The specific form of invention shown in FIG. 8 will now be described. Most of the parts of this form of invention are similar to that of the principal form of invention shown in FIGS. 1 through 5 and bear the same reference characters. The top member, however, of this variation **27*a* is formed with an opening 28*a* through which extends a pair of conductors 56 which terminate in a plug member 57. Conductors 56 are sealingly connected within opening 28*a*** so that there is no gas leakage therethrough.

Within the top member **27*a* is disposed an electric motor pump combination 58** which produces compressed air.

Figure 6:
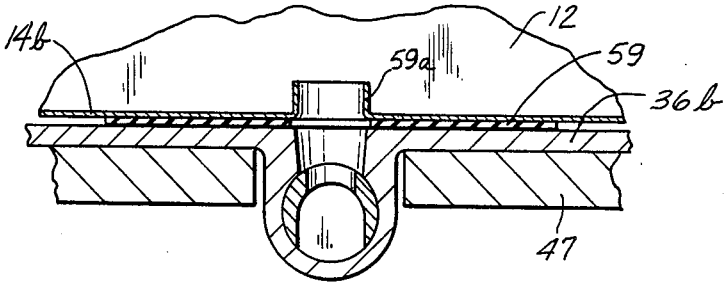
FIG. 6 is a cross-sectional view substantially similar to the view shown in FIG. 3 with the handle eliminated for clarity of illustration and showing an alternative construction of a portion of the dispenser of this invention.
Figure 7:
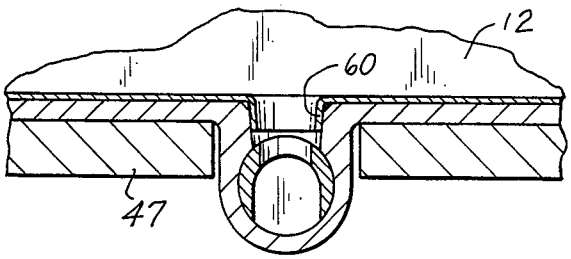
FIG. 7 is a cross-sectional view substantially similar to the view shown in FIG. 6 but showing the principal form of construction of the dispenser of this invention.

FIG. 6 shows a further variation of structure. In this figure base member **36*b* has a rubber gasket 59 disposed between the base member and the bottom of container 12. In addition, the bottom 14*b* of the container is formed with an upwardly disposed flange 59*a***.

With the foregoing specific description, the operation of this invention will now be explained.

Considering the situation involved in the principal form of this invention as shown in FIGS. 1 through 5 and 7, the container 12 is obtained which is partially filled with material 17 therewithin. The plug (not shown) is removed from bottom 14 of container 12 thereby exposing opening 15 and container 12 is laid upon base 36 with recesses 15 and 38 in alignment. The outlet valve is closed.

Plate 16 is then dropped into the top of container 12 with member 22 removed from opening 21. As plate member 16 is released it tends to drop within container 12 and any air between plate 16 and the top of material 17 is expelled through hole 21. After plate 16 comes to rest on top of the material, member 22 is then screwed into position thereby covering hole 21.

Top member 27 is then placed in position overlying container 12 and base 36 placed in position upon bottom support plate 47. Members 53 are then disposed within recesses 54 and knobs 55 tightened. Reducing valve 31 is then placed in position and element 32 placed in impinging relationship with a source of compressed air such as an air compressor, air tank, etc. At this point pressure will be built up within container 12 in the direction of the arrows 61 shown in FIG. 5. The material cannot be released because the outlet valve is closed. In order to obtain dispensing of material, handle 42 is moved thereby turning outlet valve cylinder 41 so as to open the valve and permit material to flow out through outlet opening 44. Closure of the valve will, of course, stop the flow. Excess air pressure will be relieved by the opening of relief valve 62.

Figure 8:
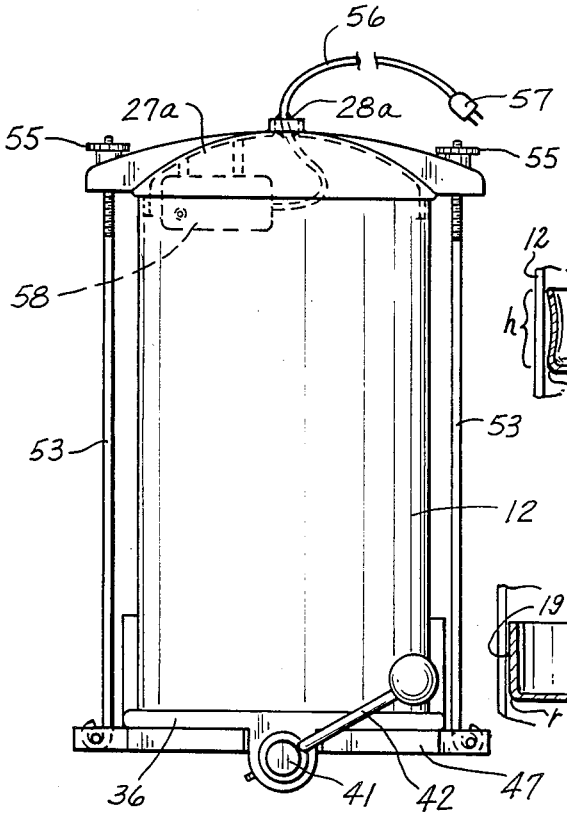
FIG. 8 is a front elevational view showing an alternative construction of the dispenser of this invention wherein the compressed gas is produced by a self-contained electrically-driven pump.

The operation of the form of invention shown in FIG. 8 is similar except, in this variation, the top member **27*a* is secured in position and plug 57 connected to a source of electrical power. As a result pump 58 compresses the air beneath member 27*a*** and produces a downward pressure which causes dispensing in the same way as in the principal form of this invention.

As previously mentioned, a dispensing device constructed according to this invention is intended for dispensing fluids having a high viscosity. By "high viscosity" it is meant fluids ranging in viscosity from about 100,000 cps to 800,000 cps. As mentioned previously a movable follower or pressure plate member 16 to which a pressurized gas (e.g. air) is applied acts to force the fluid out of the flow passage formed when valve cylinder 41 is in the open position; the flow passage being defined by outlet openings 43 and 44 previously described. Thus, valve cylinder 41 and outlet openings 43, 44 define a selectively operable valve means providing, when cylinder 41 is in open position, a fluid material flow passage out of the container. And, the follower plate 16 together with the source of compressed air for moving or driving the follower plate, therefore, broadly define a propelling means for forcing fluid out of the container 12; the compressed gas source being more broadly defined as a drive means for forcefully moving the plate member 16 toward the open valve means.

We have found that the construction of the follower plate is of critical importance in achieving effective dispensing of high viscosity materials from pressurized dispensers of the type to which this invention is directed. In this connection for example, the nature of the material of which the pressure plate is made, the clearance between the follower plate and container and the height of the side portion or wall 19 in relation to the diameter of the bottom portion or wall 18 are factors which materially affect proper operation of such dispensing devices.

One part of the follower plate which critically affects dispenser operation is the surface of the plate which faces the inside surface of the container 12. This surface is defined by the outer surface of side wall 19. In the construction shown in FIG. 5 this surface includes two sections of differing diameters. The lower of the two sections is considered as the wiping portion inasmuch as it has an outside diameter larger than section 19*b* and thus, in essence, acts to wipe the fluid material from the inner surface of the container as the follower plate is moved toward the outlet flow passage 43, 44 in the bottom of the container during dispensing. The upper of the two sections is considered as the guide portion inasmuch as it acts essentially to guide the follower plate so that it does not cock or tilt to a wedged-in or jammed attitude within the container during movement toward the outlet flow passage. In the construction shown in FIG. 9, the outer surface of side wall 19 has a concave shape defining a wiping portion at the upper of the two sections, section 19*a*, and a guiding portion at the lower of the two sections, on section 19*b*. The wiping portion has a diameter of greater than that of the largest outside diameter of the guiding portion. Of course it will be recognized that the wiping and guiding portions of the construction shown in FIG. 9 could be reversed in position so that the wiping portion is located along the leading edge of the concave outer surface of side wall 19 with the guiding portion trailing the wiping portion.

Figure 10:
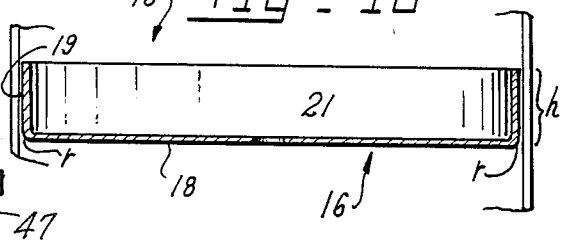
FIG. 10 is a cross-sectional view of another alternative embodiment of the follower plate constructed according to the present invention.

Another follower plate construction is shown in FIG. 10. In this construction there is no distinction between the wiping and guiding portions. Both are defined by the straight outer surface of side wall 19.

Figure 9:
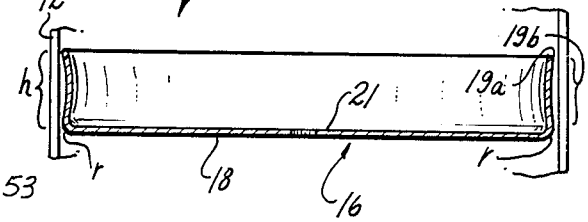
FIG. 9 is a cross-sectional view of an alternative construction of the follower plate utilized in the dispenser of the present invention.

With a follower plate constructed according to any one of the constructions shown in FIGS. 5, 9 and 10, the outside diameter of the wiping portion, according to this invention, is equal to 0.01 inch less than the inside diameter of container 12. This dimension may vary between a tolerance range of 0.025 inch on the plus side and 0.008 inch on the minus side. Thus, the overall clearance between the wiping portion of the follower plate and the inner surface of the container may vary between about 0.018 inch and zero. In other words, the outside diameter of the wiping portion of the follower plate may range between about 0.015 inch greater than the container's inside diameter (zero or negative clearance) and 0.018 inch less than the inside diameter of the container (positive clearance).

In the event a negative clearance exists between the follower plate and the container, the outside diameter of the wiping portion must be reduced by an amount approximately equal to the negative clearance. For this purpose the follower plate including the bottom and side walls 18 and 19, respectively, is made of material which is sufficiently flexible and resilient to be capable of being flexed without permanent deformation into a configuration such that the outside diameter of the wiping portion of the follower plate is reduced by the proper amount. Such flexure non-permanently deforms the bottom wall into a dish-like shape without materially changing the peripheral contour of the follower plate. With the circular follower plate as depicted in the drawings, the outside contour would remain substantially circular upon being flexed as aforesaid. As presently preferred, both the follower plate's bottom and side walls are made of a cold rolled steel alloy in sheet form having a thickness of about 0.032 inch commercially available under the designation AlSi 1010.

To prevent cocking or tilting of the follower plate, the height "h" (see FIGS. 9 and 10) of the side wall 19 is equal to at least 10% of the outside diameter of the wiping portion of the follower plate. With this arrangement, the danger that the follower plate will become jammed or wedged on an inoperative position within the container during use is effectively and advantageously eliminated.

In the presently preferred construction, the undersurface of the wall 18 of the follower plate is substantially flat (in an unflexed condition) and has a relatively smooth surface finish with substantially no surface irregularities greater than about 0.030 inch in depth. Also, in the presently preferred construction, the radius "r" (see FIGS. 9 and 10) between the side wall 19 and bottom wall 18 is advantageously controlled to be no greater than about 3/16 inch; and the side wall extends substantially perpendicular to the bottom wall within a permissable variance of plus or minus ½ degree.

Dispensers having a follower plate constructed according to this invention are extremely effective for dispensing high viscosity fluid material. With such a construction, virtually all of the fluid material can be discharged. Thus the waste occasioned by leaving fluid material in the container commonly occurring with previously known dispensing devices has now been eliminated. Also, as mentioned previously, the dispenser of this invention can be operated at significantly lower pressures thus increasing safety in operation. This is especially important in cases where the high viscosity fluid materials are packed in disposable containers made of less sturdy but more economical paperboard of fiberboard construction. Moreover, the improved follower plate construction of this invention permits easy removal of the follower plate from a spent container and easy insertion in a fresh container for subsequent use.

We claim:

1. A device for dispensing high viscosity fluid material which includes a container having an inner wall of predetermined diameter, a selectively operable valve means providing in open condition a flow passage for fluid material out of the container and propelling means movable along a wall in any one of a plurality of containers in repeated use for forcing the fluid material through the flow passage and out of the container with which it is then in use, the improvement wherein said propelling means includes:

(a) a follower plate at commencement of each use situated in contact with the fluid material within the container and mounted for movement toward the valve means, said follower plate having a bottom wall which normally is relatively flat yet deformable nonpermanently to a substantially dish-like shape under conditions of a negative clearance between said inner wall of said container and an upstanding side wall located about the periphery of the bottom wall, said upstanding side wall consisting of a wiping portion and a guide portion extending from the wiping portion throughout the remainder of the side wall, said guide portion being located to trail the wiping portion as determined with reference to the direction of movement of the follower plate within the container, and said side wall maintaining substantially its peripheral contour under circumstances resulting in deformation of said bottom wall, said follower plate being further characterized by:

1. the outer diameter of the wiping portion being greater than that of the guide portion and having one of a positive and negative clearance with respect to the inner diameter of the container of up to about 0.018 inch;
2. the side wall having an effective height equal to at least 10% of said outer diameter, said follower plate being formed of a sufficiently flexible and resilient material to undergo flexure without permanent deformation into a configuration such that the outer diameter of said wiping portion may be reduced in dimension by an amount approximately equal to any negative clearance which may exist between the follower plate and the inner wall of the container with which it is then in use, said wiping portion providing a seal to flow of fluid material from one side of said follower plate to the other,
3. the guide portion having an outer diameter substantially uniform in dimension, and
4. an orifice in said bottom wall to provide a flow path for fluid from one side of said follower plate to the other in movement of said follower plate into contact with said fluid material, yet adapted to be sealed in use of said device; and (b) drive means for forcefully moving the follower plate toward the open valve means to force fluid material out of the container through said flow passage.

* * * * *